US009267337B2

(12) United States Patent
Alaria et al.

(10) Patent No.: US 9,267,337 B2
(45) Date of Patent: Feb. 23, 2016

(54) CONNECTOR FOR TUBULAR ELEMENTS, PROVIDED WITH A FORCE TRANSMITTING MEMBER

(71) Applicant: PEGASUS S.R.L, Cirie' (Torino) (IT)

(72) Inventors: Alberto Alaria, Grosso (IT); Luca Faletto, Busano (IT)

(73) Assignee: PEGASUS S.R.L., Cirie (Torino) (IT)

( * ) Notice: Subject to any disclaimer, the term of this patent is extended or adjusted under 35 U.S.C. 154(b) by 0 days.

(21) Appl. No.: 14/371,528

(22) PCT Filed: Jan. 9, 2013

(86) PCT No.: PCT/IB2013/050188

§ 371 (c)(1),
(2) Date: Jul. 10, 2014

(87) PCT Pub. No.: WO2013/105035

PCT Pub. Date: Jul. 18, 2013

(65) Prior Publication Data

US 2014/0349505 A1 Nov. 27, 2014

(30) Foreign Application Priority Data

Jan. 12, 2012 (IT) ..... TO2012A0019

(51) Int. Cl.
*H01R 13/213* (2006.01)
*H01R 13/62* (2006.01)
(Continued)

(52) U.S. Cl.
CPC ..... *E21B 17/028* (2013.01); *H01R 13/533* (2013.01); *H01R 13/625* (2013.01)

(58) Field of Classification Search
CPC ..... E21B 17/028; E21B 17/02; H01R 13/533; H01R 13/625
USPC ..... 439/314, 318, 319; 175/40, 104
See application file for complete search history.

(56) References Cited

U.S. PATENT DOCUMENTS 3,825,079 A * 7/1974 Heilhecker ..... 340/855.1
3,980,373 A 9/1976 McCormick et al.
(Continued)

FOREIGN PATENT DOCUMENTS

GB 2 208 761 A 4/1989
GB 2 441 204 A 2/2008

OTHER PUBLICATIONS

International Search Report for PCT/IB2013/050188 dated Apr. 3, 2013.
(Continued)

*Primary Examiner* — Javaid Nasri
(74) *Attorney, Agent, or Firm* — Sughrue Mion, PLLC

(57) ABSTRACT

Electric connector, including first and second connector parts (10, 20) which can be coupled together and which comprise respectively first and second contact elements (11, 21) and first and second supports (1*a*, 3*a*) which support respectively the first and second connector parts and can be assembled together by means of screwing engagement. The first and second connector parts comprise, respectively, first and second support ring structures (13, 23) which carry the first and second contact elements respectively. Pins and corresponding locating and drive means (31, 32) are designed to make the first and second support rings structures rotationally integral during relative engagement of first and second supports and cause first and second contact elements to align with one another. The first connector part also comprises a base structure (15) on which the first support ring structure is movably mounted. Cam members (18) are arranged between base structure and support ring structure.

10 Claims, 15 Drawing Sheets

(51) Int. Cl.

| | |
|---|---|
| ***E21B 17/02*** | (2006.01) |
| ***H01R 13/533*** | (2006.01) |
| ***H01R 13/625*** | (2006.01) |

(56) References Cited

U.S. PATENT DOCUMENTS

| | | | |
|---|---|---|---|
| 6,929,493 | B2 | 8/2005 | Hall et al. |
| 2006/0021799 | A1 | 2/2006 | Hall et al. |
| 2007/0284873 | A1 | 12/2007 | Funke |
| 2009/0166087 | A1 | 7/2009 | Braden et al. |

OTHER PUBLICATIONS

Written Opinion for PCT/IB2013/050188 dated Apr. 3, 2013.

* cited by examiner

CONNECTOR FOR TUBULAR ELEMENTS, PROVIDED WITH A FORCE TRANSMITTING MEMBER

CROSS REFERENCE TO RELATED APPLICATIONS

This application is a National Stage of International Application No. PCT/IB2013/050188 filed Jan. 9, 2013, claiming priority based on Italian Patent Application No. TO2012A000019 filed Jan. 12, 2012, the contents of all of which are incorporated herein by reference in their entirety.

BACKGROUND

The present invention relates to a connector including:

a first connector part and a second connector part which can be coupled to each other and comprise at least one first end part of a conduit or transmission line and at least one second end part of a conduit or transmission line, respectively, for contacting with one another when first and second connector parts are coupled to each other; and a first tubular element and a second tubular element which support the first and the second connector parts, respectively, and can be assembled with one another by means of an engaging movement so as to obtain coupling between the first and second connector parts, said engaging movement comprising a component of relative rotation of first and second tubular elements, about a longitudinal axis thereof, wherein said first and second connector parts comprise a first support ring structure and a second support ring structure, respectively, which carry the first end part of a conduit or transmission line and the second end part of a conduit or transmission line, respectively.

An example of connectors of this type consists of connectors used in the oil and gas industry for forming electric lines inside drill strings used to drill wells. These electric lines are used to transmit to the surface signals indicating the operating condition of the drilling equipment or the environmental or geological conditions inside the well.

Generally the drill strings used comprise hundreds of pipes and any other components connected in series. The electric lines must therefore transmit their signals through all the joints between successive components in the strings. Consequently, a single defective connection may result in the entire line malfunctioning.

There are different factors which affect the reliability of the connectors. Firstly, since in general the connection between components of the drill string is performed by means of screwing and since the manufacturing tolerances of the drilling components generally do not guarantee the degree of precision required by electrical equipment it may happen that, once assembly has been performed, the electrical contacts of successive components are not aligned with each other and/or there remains between them an axial gap which prevents contact from being achieved. Moreover a certain relative angular displacement between two components may occur accidentally during operation of the drill string, resulting in misalignment of the contacts.

These problems have been considered for example in U.S. Pat. No. 6,929,493 which describes a connector of the type defined at the start. The connector in U.S. Pat. No. 6,929,493 comprises a pair of annular contacts which are housed in respective annular seats, being embedded in an elastic material. Although this device appears to solve the problems mentioned above, it appears however that it is able to offset only partially manufacturing tolerances which are not very large.

SUMMARY OF THE INVENTION

One object of the invention is therefore that of providing a connector which solves effectively the aforementioned problems.

The invention therefore relates to a connector of the type defined initially in which:

said first and second end parts of a conduit or transmission line are positioned along a circumferential arc of the first support ring structure and second support ring structure, respectively; and said first connector part further comprises a base structure which is fixed to said first tubular element and on which said first support ring structure is mounted for axial movement and rotation about the longitudinal axis, there being provided locating and drive means which are arranged between first and second support ring structures and which are designed to make said first and second support ring structures rotationally integral with one another during a final stage of the relative engaging movement of first and second tubular elements and cause first and second end parts of a conduit or transmission line to align with one another, and there being provided force-transmitting means which are arranged between base structure and first support ring structure and which are designed to axially bias the first support ring structures against the second support ring structure during a final stage of the relative engaging movement of first and second tubular elements, thereby achieving coupling between first and second connector parts.

According to this proposed solution, the locating and alignment means positioned between first and second support ring structures prevent misalignment of the end parts of the conduit or transmission line during assembly of the tubular elements, while the force-transmitting means positioned between base structure and first ring structure prevent axial spaces remaining between these end parts. Moreover, the fact that the first support ring structure is movable rotationally with respect to its base structure allows any relative angular displacement of the supports to be compensated for during operation.

The invention also relates to a connection device designed to be coupled to a complementary device, comprising:

a tubular element designed to be assembled with a corresponding tubular element of the complementary device by means of an engaging movement, said engaging movement comprising a component of relative rotation of said tubular elements, about a longitudinal axis thereof;

an end part of a conduit or transmission line for contacting with a corresponding end part of a conduit or transmission line of the complementary device; and a support ring structure carrying the end part of a conduit or transmission line of the connection device;

characterized in that said end part of a conduit or transmission line is positioned along a limited circumferential arc of the support ring structure, there being provided locating and drive means on an abutment surface of said support ring structure which are designed to make said support ring structure rotationally integral with a corresponding ring structure of the complementary device during a final stage of the relative engaging movement of the tubular element of the connection device and the tubular element of the complementary device and cause the end part of a conduit or transmission line of the connection device to align with the end part of a conduit or transmission line of the complementary device.

BRIEF DESCRIPTION OF THE DRAWINGS

Further characteristic features and advantages of the connector according to the invention will become clear from the detailed description which follows with reference to the accompanying drawings which are provided purely by way of a non-limiting example and in which.

DETAILED DESCRIPTION OF THE INVENTION

Figure 1:
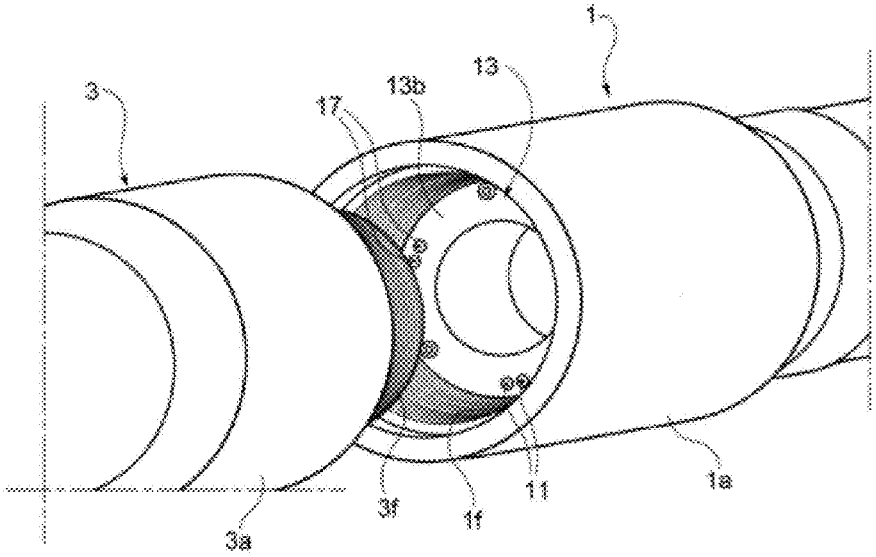
FIGS. 1 and 2 show perspective views of a pair of tubular elements during assembly, from different view points.
Figure 2:
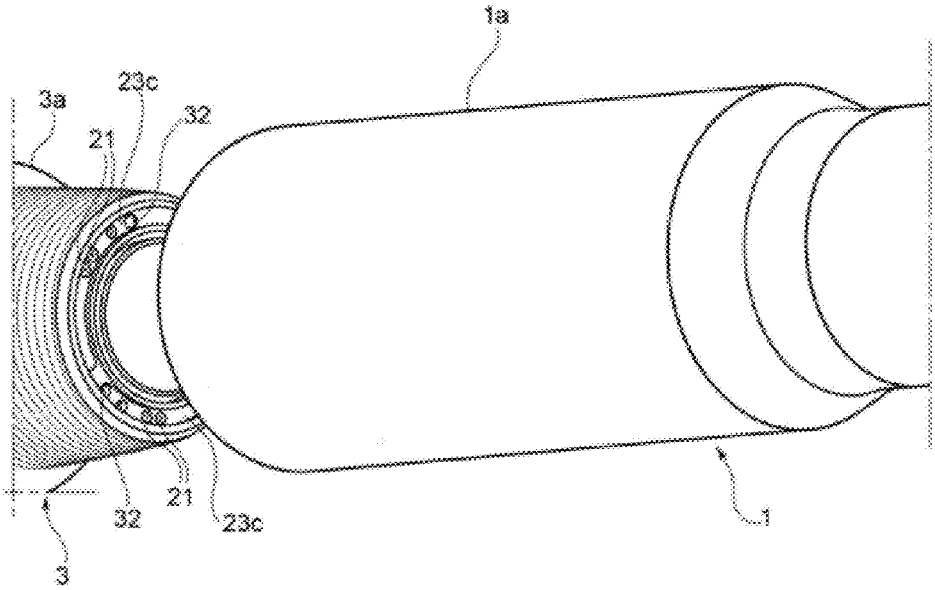
Figure 3:
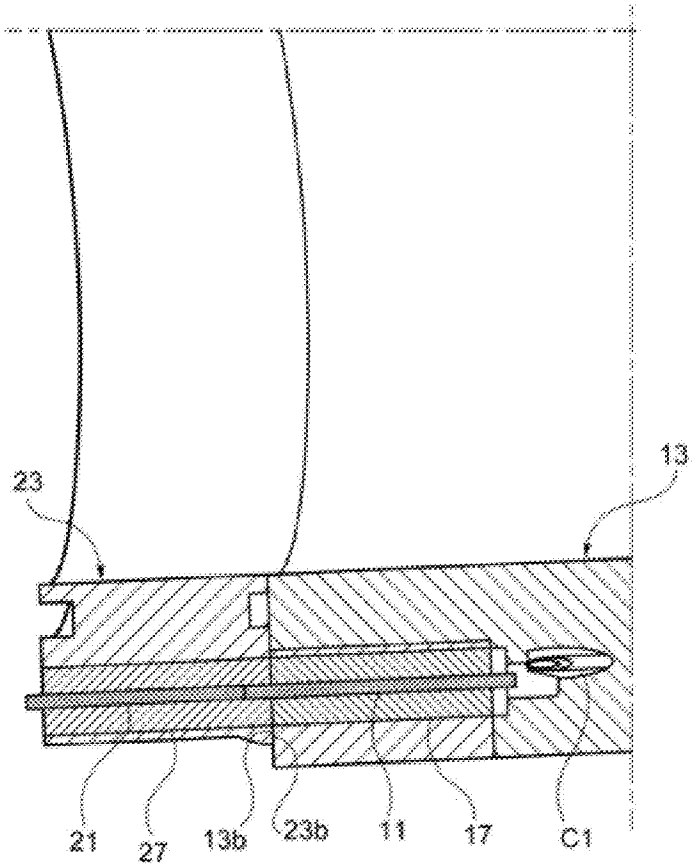
FIG. 3 shows a longitudinally sectioned view of a detail of the tubular elements of FIGS. 1 and 2, in the assembled condition.
Figure 4:
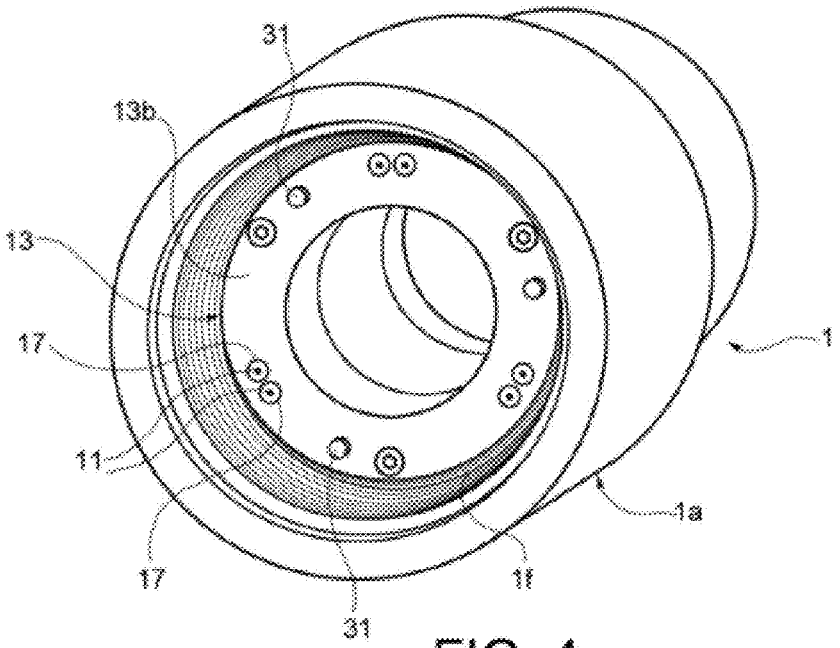
FIGS. 4 and 5 show respectively a perspective view and a front elevation view of an end portion of one of the tubular elements according to FIGS. 1 and 2.
Figure 5:
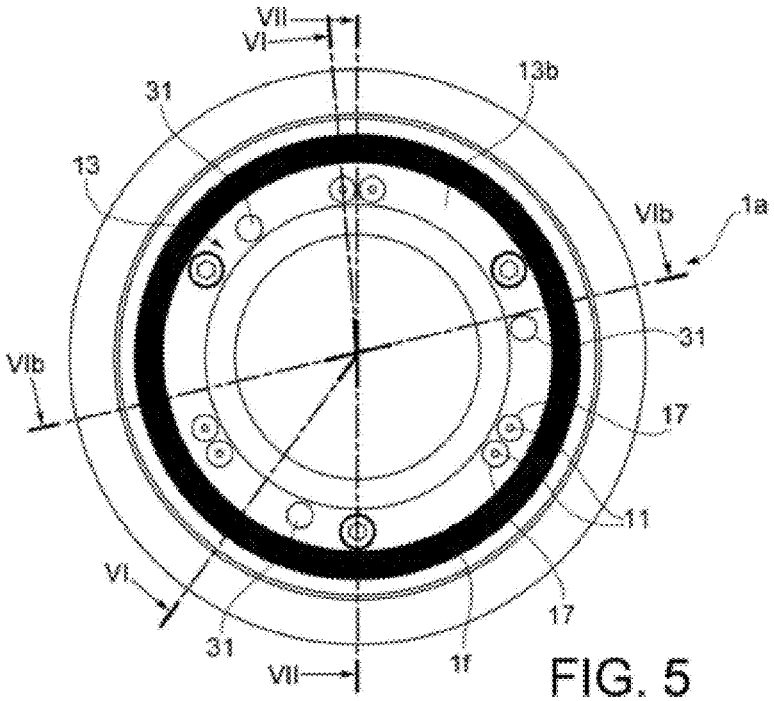

FIGS. 1 and 2 show a pair of tubular elements indicated respectively by the reference numbers 1 and 3, during assembly, i.e. with assembly not yet completed. The tubular elements shown in FIGS. 1 and 3 are in particular drilling pipes; the invention however is not limited to this specific application and may be used in other technological sectors in addition to that of ground drilling. Other tubular elements to which the invention may be applied are, for example, those used to construct fluid conveying piping or those for forming wells in marine areas.

The tubular elements 1 and 3 have end connection elements which are intended to form the joint between consecutive tubular elements. In the example shown these end elements are provided with threads. In particular, in FIGS. 1 and 2, 1*a* denotes the end element intended to form the female part of the joint and provided with an internal thread, while 3*a* denotes the end element intended to form the male part of the joint and provided with an external thread. FIGS. 1 and 2 show the internal thread if and the external thread 3*f*, respectively, of the female end element 1*a* and the male end element 3*a*.

The invention however relates to the more general case where the tubular elements are assembled together by means of an engaging movement comprising a component of relative rotation of the first and second tubular elements, about a longitudinal axis thereof. The screw connection therefore represents a particular type of engaging connection which has a component of rotation; another example consists of a bayonet connection.

In the example shown, each tubular element 1, 3 has, arranged inside it, a respective electric cable portion C1, C3 (shown for example in FIGS. 6*a*, 6*b* and 10*a*, 10*b*) which is passed inside holes or grooves formed in the body of the end elements of the tubular elements. The invention however relates to the more general case where the tubular elements are provided with conduits, such as ducts for conveying fluids or simple passages for inserting instruments, or transmission lines, such as electrical or optical transmission lines. These conduits or transmission lines may be arranged within the thickness of the side wall of the tubular elements or on the inner side or on the outer side of this wall. The electric cable portion of the present example therefore constitutes a particular example of a transmission line.

The female end element 1*a* and male end element 3*a* support, respectively, a first and a second connector part, which are denoted by 10 and 20 (shown for example in FIGS. 6*a*, 6*b* and 10*a*, 10*b*). These first and second connector parts 10, 20 are housed inside respective annular seats formed in shoulder surfaces of the female end element 1*a* and the male end element 3*a* and are therefore arranged coaxially with the common axis of extension defined by the tubular elements 1 and 3, with respect to which, consequently, the female end element 1*a* and the male end element 3*a* extend coaxially. In the example considered, the axis of extension of the tubular elements 1 and 3 is in fact also the engaging axis of these tubular elements.

The first connector part 10 and the second connector part 20 can be coupled together and comprise, respectively, at least one first end part 11 of a conduit or transmission line and at least one second end part 21 of a conduit or transmission line, for contacting with one another when the first and second connector parts are coupled together. Coupling between the first and second connector parts is achieved when the female end element 1*a* and the male end element 3*a* are engaged with each other, as shown in FIG. 3.

In the example shown, the first and second end parts 11, 21 of a conduit or transmission line are formed respectively by a first and a second contact element made of conductive material, which are able to close an electric contact with each other when the first and second connector parts are coupled together. Clearly, this is only one example which relates to the case where the conduit or transmission line is an electric transmission line; in the case of an optical transmission line the end part 11, 21 may consist for example of an optical-fibre end part, while in the case of a conduit the end part 11, 21 may consist for example of a conduit inlet. In the remainder of the present description for the sake of convenience on some occasions reference will be made only to "contact elements", it being understood, however, that these elements represent more generally end parts of a conduit or transmission line.

As can be seen more clearly in FIGS. 4, 6*a*, 6*b* and 7*a*-7*c*, the first connector part 10 comprises a support ring structure 13 which is associated with the first support 1 and which supports in turn the first end part 11 of a conduit or transmission line. The first end part 11 of a conduit or transmission line is positioned along a circumferential arc of the support ring structure 13. "Circumferential arc" is understood as meaning an arc of the circumference of the support ring structure 13 having a length such that the ratio of the length of the arc to the length of the circumference of the support ring structure is less than 1. The end portion C1 (or the optical fibre) is passed inside a duct formed inside the body of the support ring structure 13 so as to connect this cable portion (or optical fibre) to the first end part 11 of the conduit or transmission line. In the case where, instead of the electrical or optical transmission line, a conduit for conveying fluids or for guiding instruments is present, the same duct formed inside the body of support ring structure 13 could form part of this conduit, while the first end part of the conduit could be formed by an inlet of the conduit arranged on an abutment face of the support ring structure.

Considering again the example shown, a bush body 17, which is made of insulating material and inside which the first contact element 11 is housed, is fixed inside a seat formed on an abutment face 13*b* of the support ring structure 13. As can be seen in particular in FIGS. 3, 6*a* and 7*a*-7*c*, the first contact element 11 has the form of a bar and is inserted inside the respective bush body 17. In the example shown there are three pairs of contact elements 11 which are connected to three respective electric cable portions C1 which, in the example considered, consists of a bipolar cable.

The first contact element 11 projects outwards from the abutment surface 13*b* of the support ring structure 13.

The first connector part 10 also comprises a base structure 15 which is fixed to the first tubular element 1, which also has a ring shape, and is arranged coaxially with the axis of extension of the first tubular element 1. A non-limiting example of a measure for fixing this base structure 15 to the end element 1*a* of the tubular element 1 envisages a plurality of pins, dowels or transverse eccentric screws 15*a* (one of which is visible in FIG. 6*b*) which are inserted inside through-holes formed through the side wall of the end element 1*a* and which engage inside corresponding blind holes formed in the outer side surface of the base structure 15. These pins 15*a* axially and rotationally retain the base structure 15 on the end element 1*a* and moreover exert a tightening action in the axial direction between base structure 15 and end element 1*a*, such as to compress a seal 15*b* arranged between them. Obviously other axial and rotational locking means are possible.

Figure 6A:
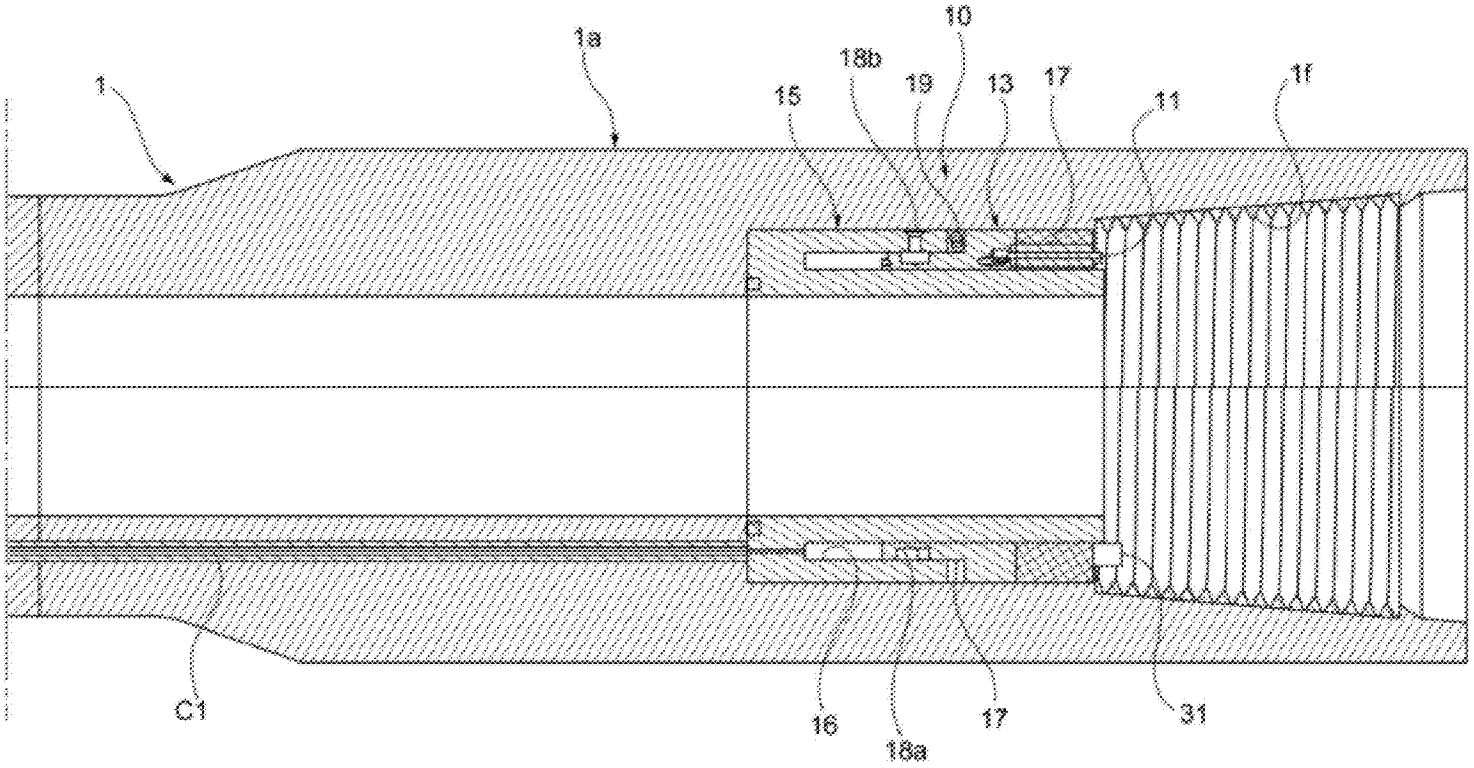
FIGS. 6*a* and 6*b* show longitudinally sectioned views of the end portion of FIGS. 4 and 5, in the rest position, viewed along the lines VI-VI and VIb-VIb of FIG. 5.
Figure 6B:
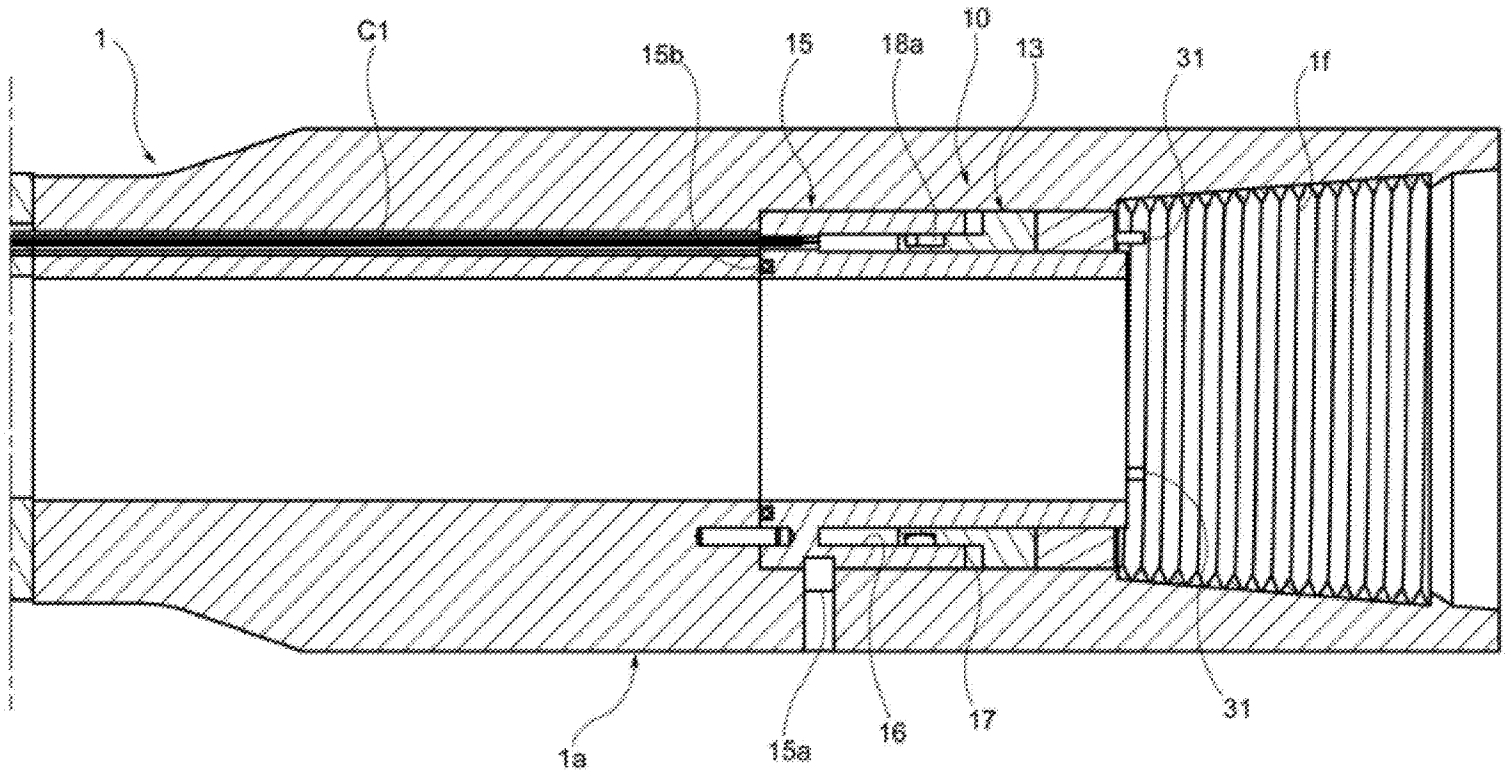

The first support ring structure 13 is mounted on the aforementioned base structure 15, being movable axially and rotatably with respect thereto, about the longitudinal axis of the tubular element 1. More precisely, the base structure 15 has an annular cavity 16 which is formed along its entire perimeter and inside which a collar portion 17 of the first support ring structure 13, which extends in a proximal direction from the first support ring structure 13, is slidingly inserted. Advantageously, the annular cavity 16 of the base structure 15, in addition to acting as a guide for the movement of the collar portion 17, also provides a space for storing a portion of the electric cable C1 (or optical fibre) which is housed in a loose manner inside it. The electric cable (or optical fibre) passes through this cavity 16, coming from a passage formed through the support ring structure 13, and emerges from the cavity 16 through a passage formed through the base structure 15, and then extends towards the remainder of the tubular element 1 (as shown in FIGS. 6*a* and 6*b*).

Figure 7A:
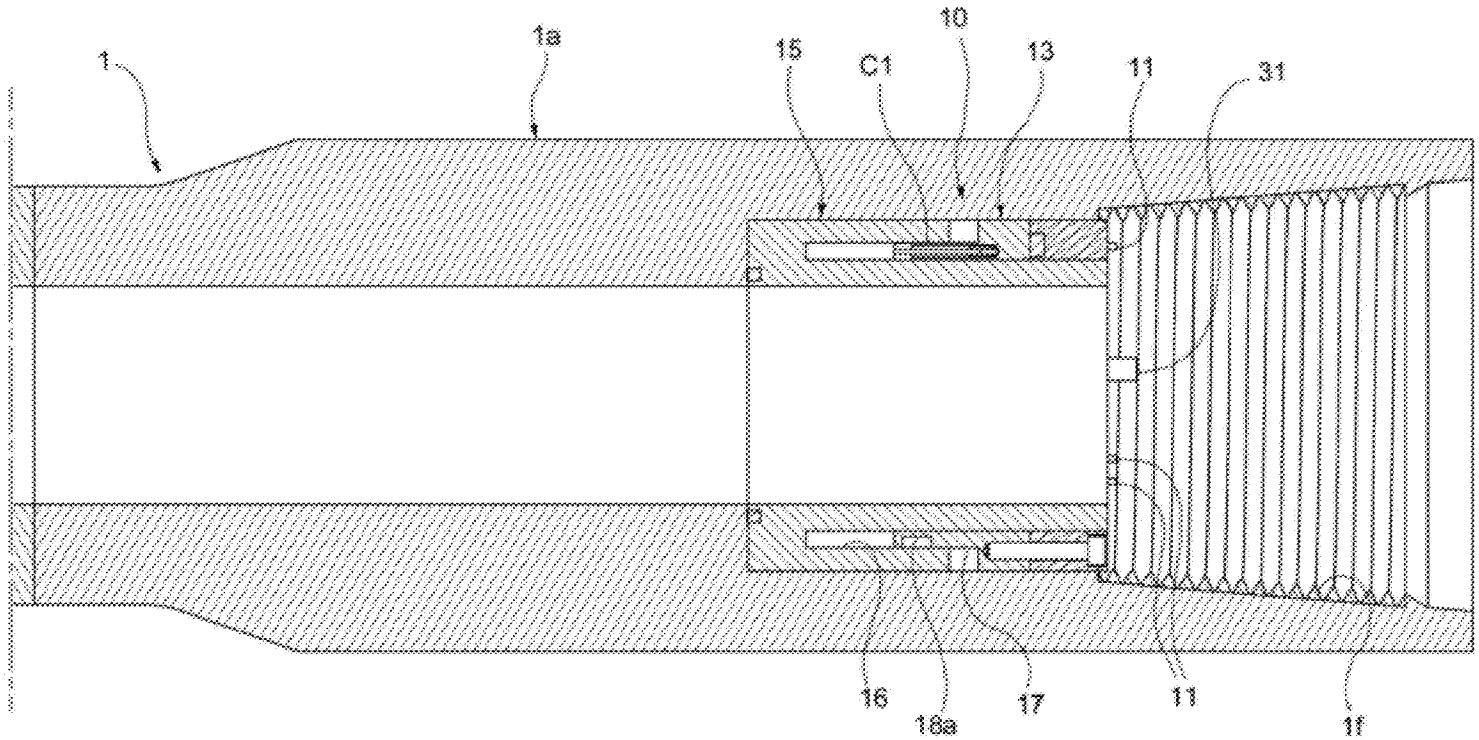
FIGS. 7*a*-7*c* show, respectively, a longitudinally sectioned view along the line VII-VII of FIG. 5, a longitudinally sectioned view along the line VI-VI of FIG. 5, and a perspective view of a component of the end portion of FIGS. 4 and 5, in the coupled position.
Figure 7B:
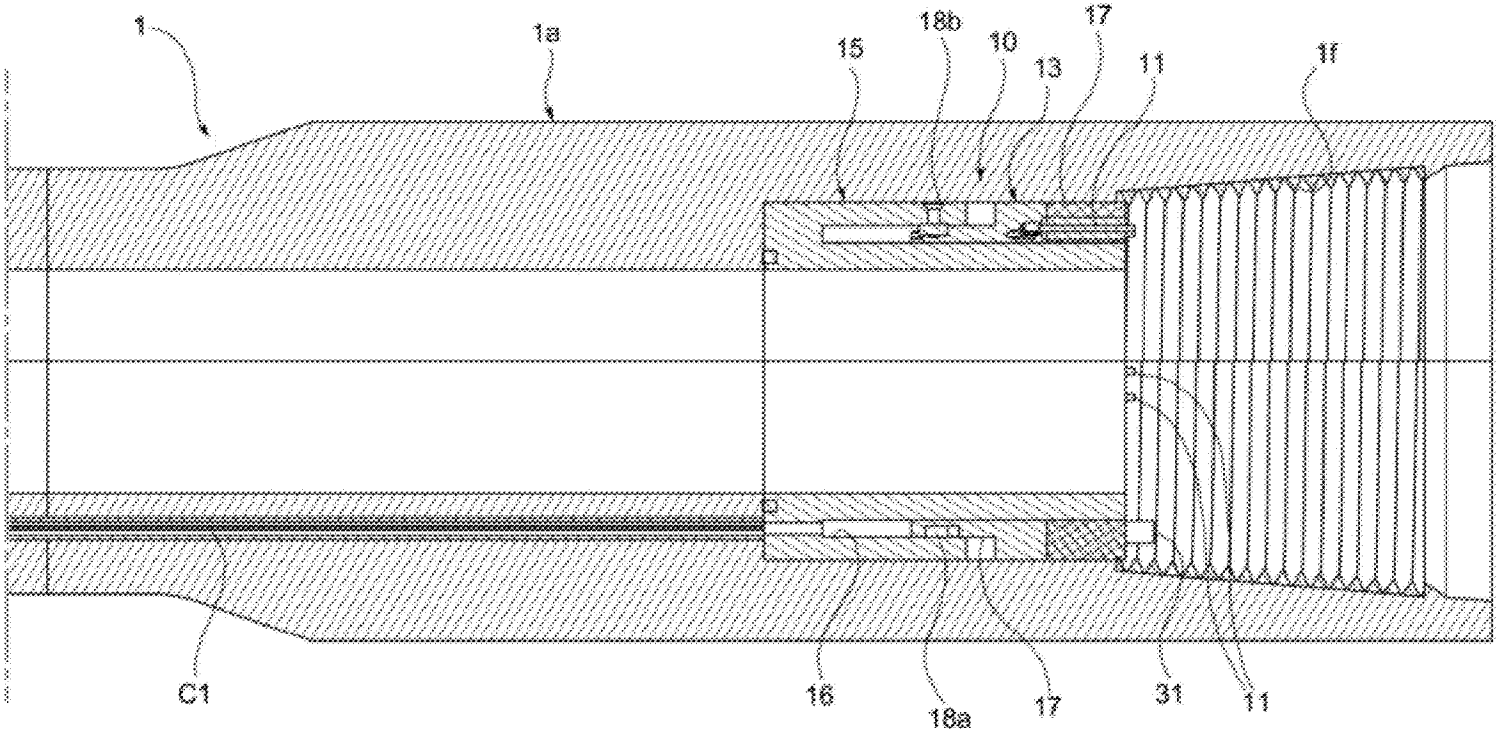
Figure 7C:
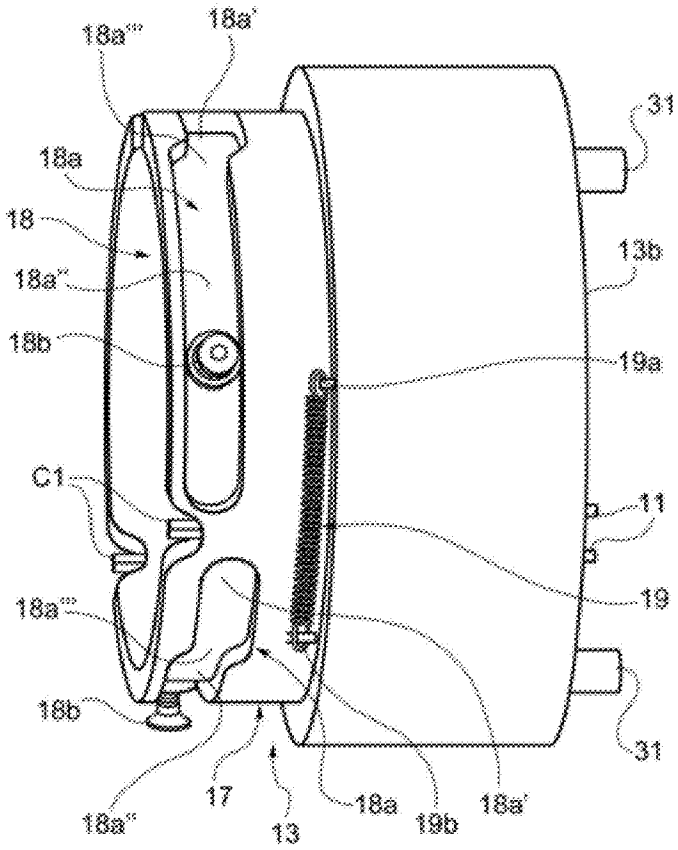
Figure 8:
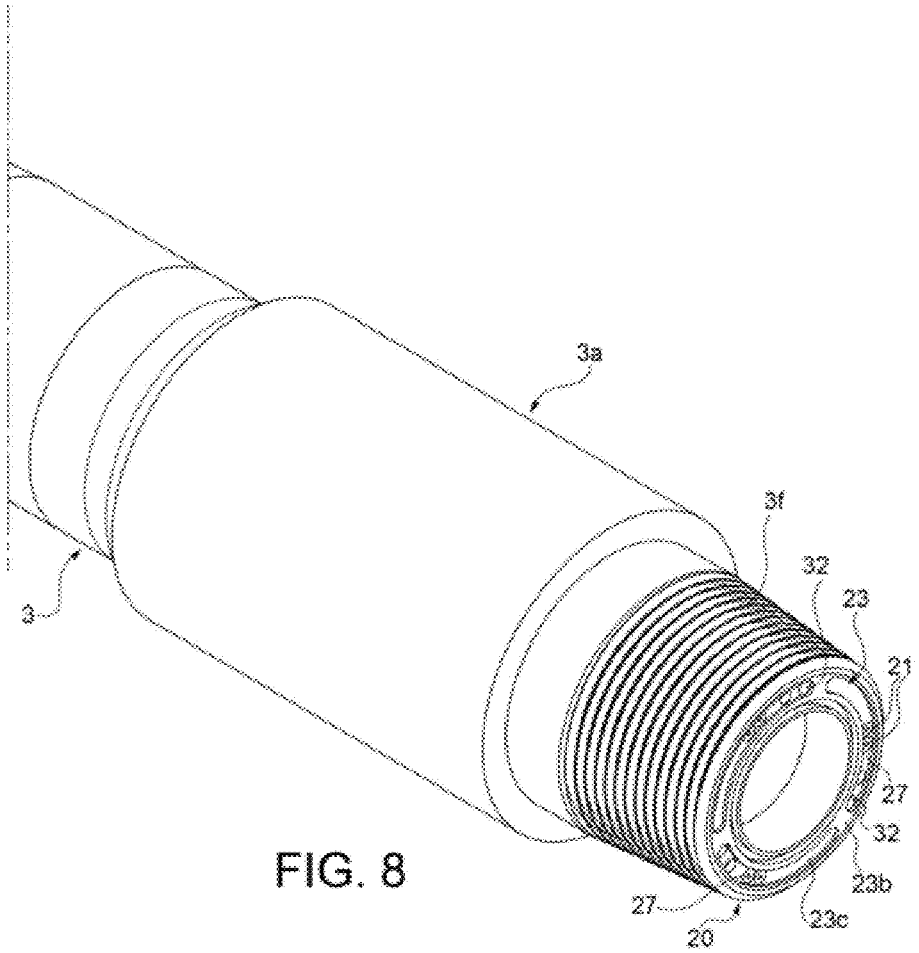
FIGS. 8 and 9 show, respectively, a perspective view and a front elevation view of an end portion of the other one of the tubular elements according to FIGS. 1 and 2.

Between first support ring structure 13 and base structure 15 or, more precisely, between the collar portion 17 and a wall of the base structure 15 facing the annular cavity 16 there is provided a cam member 18 which acts as a force-transmitting member, as can be seen more clearly in FIG. 7*c*, which shows the first support ring structure 13 viewed separately. In the example shown, there are three separate cam members 18 which have the same form and which operate in synchronism. More precisely, the cam member 18 comprises a cam groove 18*a* formed on a radially outer surface of the collar portion 17 and comprising an initial groove section 18*a*', extending parallel to the circumferential direction, a final groove section 18*a*" also extending parallel to the circumferential direction and arranged in an axially inner position with respect to the initial groove section 18*a*', and an inclined connecting/transition groove section 18*a*'" which joins the initial groove section 18*a*' to the final groove section 18*a*". The cam member 18 also comprises a cam follower 18*b* which guidedly engages in the cam groove 18*a* and is integral with the base structure 15, not shown in FIG. 7*c*. Preferably, the cam follower 18*b* consists of a stud provided with a bearing for facilitating sliding of the cam follower 18*b* inside the cam groove 18*a*.

An elastic recall member 19 (visible in FIGS. 6*a* and 7*c*), in particular a helical spring, is also provided between first support ring structure 13 and base structure 15, said recall member being connected at one end 19*a* to the first support ring structure 13 and at the other end 19*b* to the base structure 15. This elastic recall member 19 is arranged so as to bias the support ring structure 13 in the circumferential direction towards its rest position (shown in FIGS. 6*a* and 6*b*). It therefore has the function of bringing the support ring structure 13 back into its rest position when the tubular elements 1 and 3 are disassembled from each other.

The cam member 18 therefore allows relative rotation of the first ring structure 13 and base structure 15 along a section corresponding to its length in the circumferential direction, introducing an axial component of movement along its connecting groove section 18*a*'". As a consequence of this axial component of movement, the first support ring structure 13 is able to move forwards or backwards with respect to the base structure 15. When the cam follower 18*b* is located along the initial groove section 18*a*' of the guide groove 18*a* the first support ring structure 13 is in the retracted position, or rest position (shown in FIGS. 6*a* and 6*b*); when instead the cam follower 18*b* is in the final groove section 18*a*" of the guide groove 18*a*, the first support ring structure 13 is in the advanced position, or coupled position (shown in FIGS. 7*a* and 7*b*).

Figure 9:
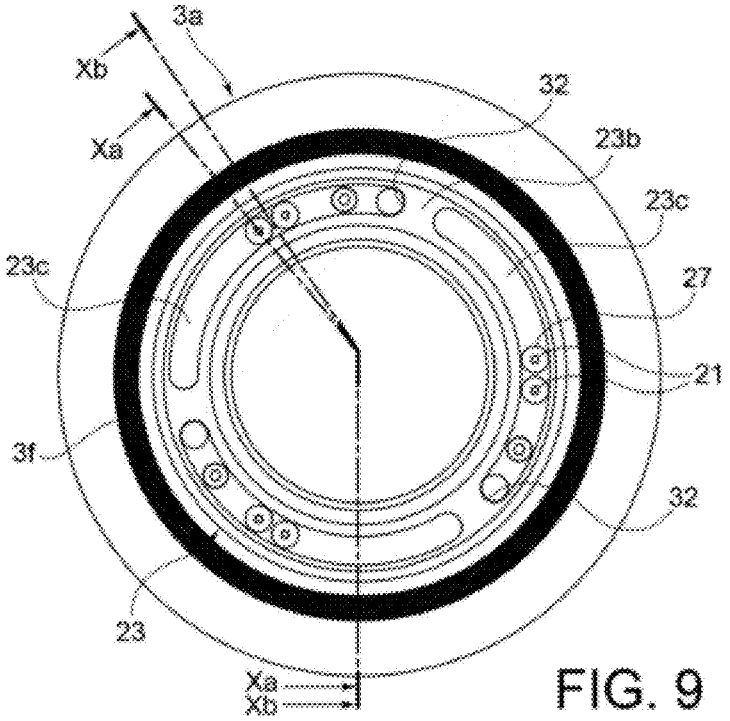
Figure 10A:
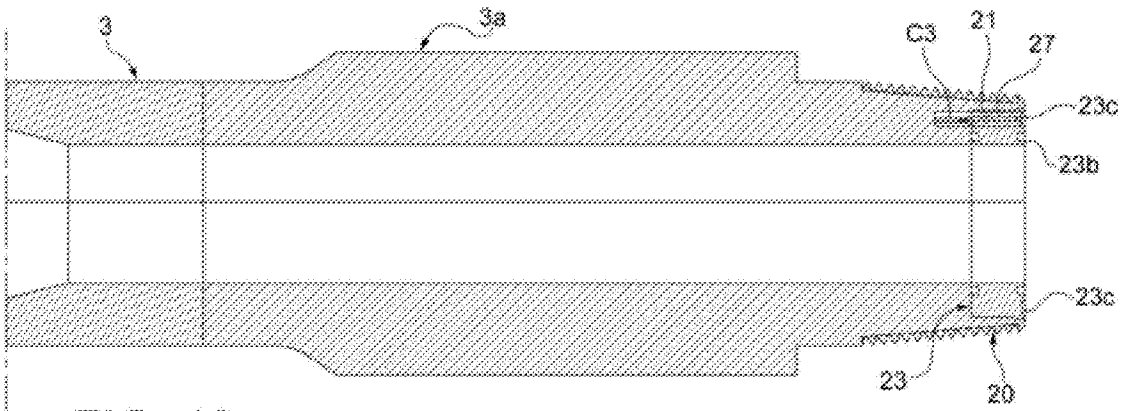
FIGS. 10*a* and 10*b* show longitudinally sectioned views of the end portion of FIGS. 8 and 9, viewed along the lines Xa-Xa and Xb-Xb of FIG. 9.
Figure 10B:
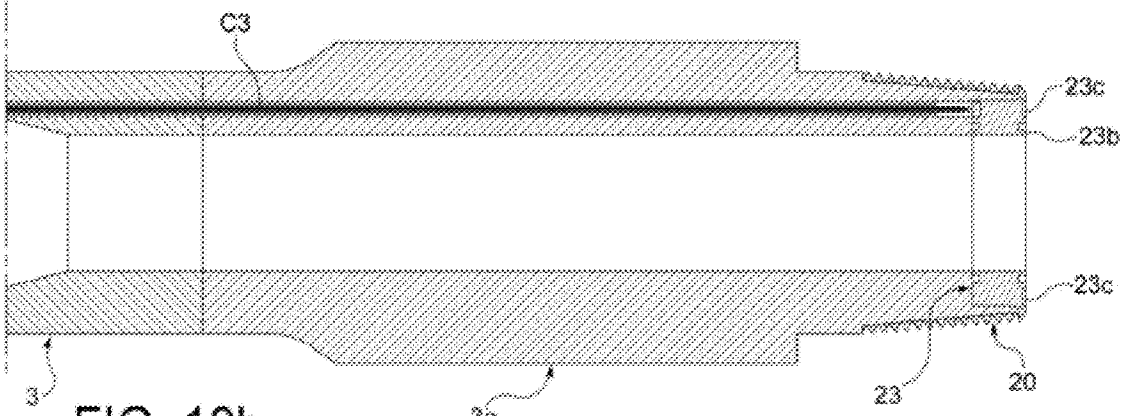

As can be seen more clearly in FIGS. 9, 10*a* and 10*b*, the second connector part 20 comprises a support ring structure 23 which is integral with the end portion 3*a* of the tubular element 3. This support ring structure 23 may be formed as one piece with the end part of the tubular element 3 or fixed thereto. The support ring structure 23 receives the second end part 21 of the conduit or transmission line, which, in a manner similar to that commented above in connection with the first connector part, in the example shown consists of a (second) contact element. This contact element 21 is connected electrically to the cable portion C3 associated with the second drilling pipe 3.

The second contact element 21 is positioned along a limited circumferential arc of the support ring structure 23. In particular, the second contact element 21 has the form of a bar and is inserted in a stationary manner inside a casing 27 which is in the form of a bush and made of insulating material and which in turn is inserted in a stationary manner inside a seat formed in an abutment surface 23*b* of the support ring structure 23. In the example shown there are three pairs of second contact elements 21 which are connected to three respective electric cable portions C3 which, in the example considered, consists of a bipolar cable.

As can be seen in particular in FIG. 10*a*, the second contact elements 21 are arranged so as to have their respective distal surfaces inset with respect to the abutment surface 23*b* of the support ring structure 23.

According to the invention locating and drive means are provided, these being designed to make the first and second support rings structures 13, 23 rotationally integral during engagement between the first and second tubular elements 1, 3, and cause said first and second contact elements 11, 21 to align with one another.

In the example shown, these locating and drive means consist of at least one pin 31 and at least one corresponding hole 32 respectively arranged on either one of the abutment surfaces 13*b* and 23*b* of the first and second support ring structures 13, 23. In the example shown, three pins 31 project axially from the abutment surface 13*b* of the first support ring structure 13 and three corresponding holes 32 are formed on the abutment surface 23*b* of the second support ring structure 23. As an alternative to the pins, there may be also present other elements projecting from the abutment surfaces, such as teeth or ribs, designed to engage in corresponding recesses with a complementary form, or also quick-fit elements.

During the final stage of engagement (in this specific case, screwing) together of the tubular elements 1 and 3, at a certain point (determined by setting the angular position of the pin 31 depending on the mutual positions of the two connector parts 10, 20 at the end of screwing), the pin 31 of one connector part 10 starts to engage with the respective hole 32 of the other connector part 20. In order to prevent interference between the pin 31 and the abutment surface 23*b* situated opposite it, before the pin 31 engages inside the respective hole 32, the aforementioned surface is provided with a recess 23*c* extending in the form of an arc and situated in front of the hole 32 with respect to the direction of relative rotation of the two connector parts 10, 20.

Once engagement has been achieved between pin and hole the first and second support ring structures 13, 23 are fixed together and the first contact elements 11 (first end parts of the conduit or transmission line) remain aligned with the respective second contact elements 21 (second end parts of the conduit or transmission line). Continuing the screwing action, the first support ring structure 13 is therefore driven rotationally with respect to the base structure 15, against the action of the helical spring 19. The cam follower 18*b* integral with the base structure 15 therefore travels along the cam groove 18*a*, integral with the first ring structure 12, from the initial groove section 18*a*', through the transition groove section 18*a*''' and as far as the final groove section 18*a*''. When the transition section 18*a*''' of the cam groove 18*a* is passed through, the first ring structure 12 advances from the rest position shown in FIGS. 6*a* and 6*b* to the coupled position shown in FIGS. 7*a* and 7*b*. During this advancing movement the pins 31 penetrate gradually inside the respective holes 32; for their part the first contact elements 11 are made to enter axially inside the bush-type casing 27 of the second contact elements 21 and finally brought into end-to-end contact with these second contact elements, thus obtaining closing of the electric contact, as shown in FIG. 3.

Coupling between the first and second connector parts 10, 20 is therefore completed by the fact that the first support ring structure 13 is biased by the cam member 18 against the second support ring structure 23, with the respective abutment surfaces 13*b*, 23*b* in mutual contact, thus ensuring a hydraulic seal which prevents liquids and dirt from penetrating into the seats housing the contact elements 11, 21.

Any further screwing together of the tubular elements once the coupled position has been reached is compensated for by the extension of the final groove section 18*a*''' which allows a further relative rotation by a variable amount of the first/second support ring structure 13, 23 and base structure 15 and therefore of the tubular elements 1 and 3.

The contact between first and second contact elements 11, 21 is thus maintained by the gripping force of the cam member 18 of the support ring structure 13 of the first connector part 10 which biases the first contact element 11 against the second contact element 21. In order to prevent the electrical parts from coming into contact with water, sludge or other liquids during operation, seals (not shown) are provided, being arranged in an manner which may be easily determined by the person skilled in the art, for example on the abutment surfaces 13*b* and 23*b* and on the casing 17 and 27 of the first and second contact elements 11, 21.

Figure 11:
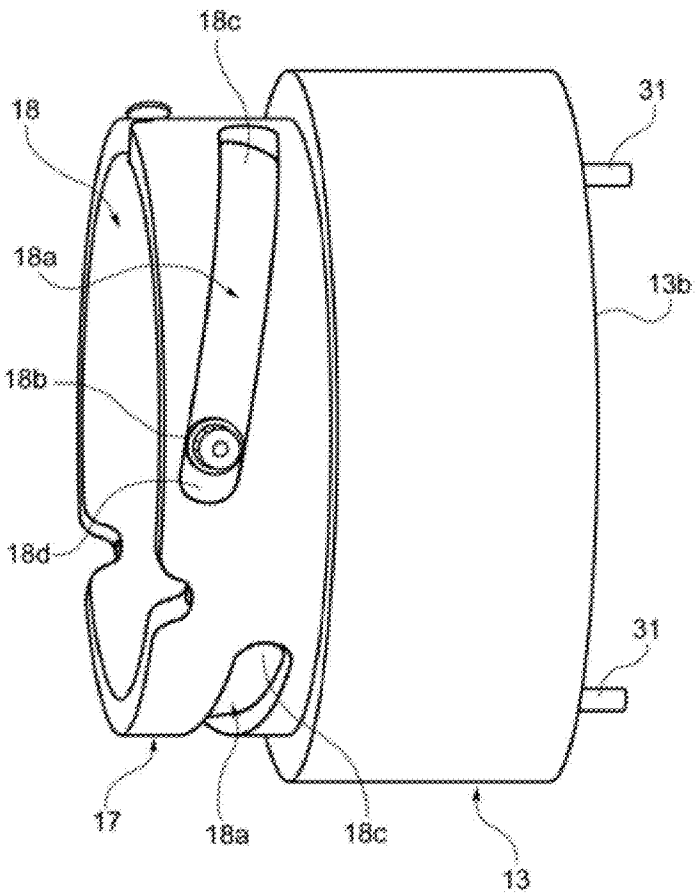
FIG. 11 shows a perspective view of a component of the end portion of FIGS. 4 and 5, according to a second embodiment of the invention.

FIG. 11 shows the support ring structure of the first connector part, according to a second embodiment of the invention. Parts which correspond to those of the preceding embodiment have been assigned the same reference numbers and will not be further described.

The second embodiment shown in FIG. 11 differs from the preceding embodiment in that the cam groove 18*a* of the cam member 18 does not have the initial groove section and the final groove section and comprises only the inclined transition groove section which extends obliquely with respect to the circumferential direction.

The cam member 18 of the second embodiment therefore allows a relative rotation of first ring structure 13 and base structure 15 along an extension corresponding to its length in the circumferential direction, introducing an axial component of movement along its entire extension. As a consequence of this axial component of movement, the first support ring structure 13 is able to move forwards or backwards with respect to the base structure 15. When the cam follower 18*b* is located at one end 18*c* of the guide groove 18*a* the first support ring structure 13 is in the retracted position, or rest position (similar to that of FIGS. 6*a* and 6*b*); when instead the cam follower 18*b* is at the opposite end 18*d* of the guide groove 18*a*, the first support ring structure 13 is in the advanced position, or coupled position (similar to that shown in FIGS. 7*a* and 7*b*).

Obviously other forms of the cam groove 18*a*, for example a curvilinear form, are possible, provided that this groove is able to introduce an axial component of movement of the first support ring structure 13 with respect to the base structure 15 owing to a relative rotation of said structures.

Figure 12:
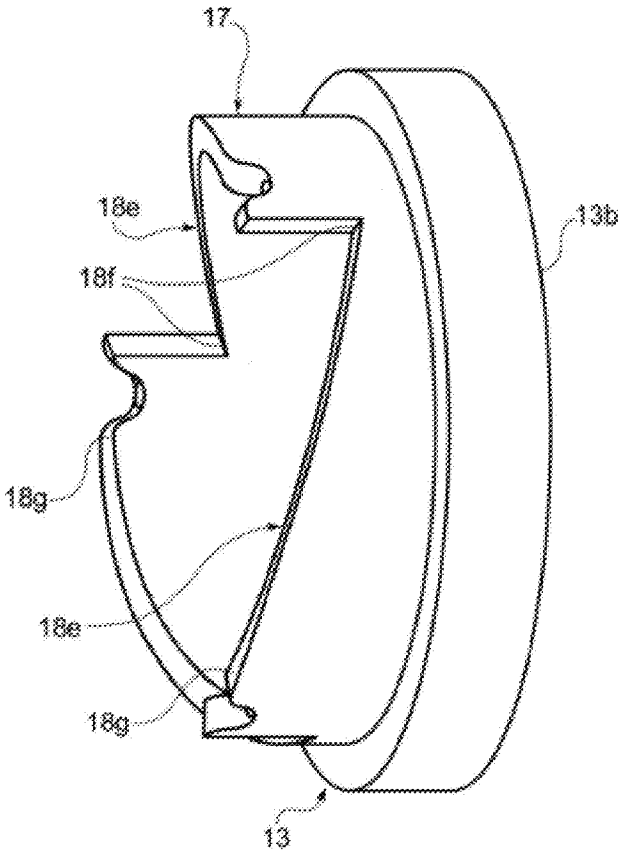
FIG. 12 shows a perspective view of a component of the end portion of FIGS. 4 and 5, according to a third embodiment of the invention.

FIG. 12 shows the support ring structure of the first connector part, according to a third embodiment of the invention. Parts which correspond to those of the preceding embodiments have been assigned the same reference numbers and will not be further described.

The third embodiment shown in FIG. 12 differs from the second embodiment in that the cam member 18 (in fact, an inclined surface) does not comprise a cam groove, but cam surfaces 18*e* formed frontally on the edge of the collar portion 17 of the support ring structure 13, and extend obliquely with respect to the circumferential direction. In this case, the cam member 18 also comprises a complementary member (not shown) integral with the base structure 15 and designed to engage with the aforementioned inclined surfaces, which member may be similar to the cam follower of the preceding embodiments, or may consist of inclined cam surfaces shaped so as to complement the inclined cam surfaces 18*e* of the collar portion 17 of the support ring structure 13.

The cam member 18 of the third embodiment therefore allows relative rotation of first ring structure 13 and base structure 15 along an extension corresponding to its length in the circumferential direction, introducing an axial component of movement along its entire extension. As a consequence of this axial component of movement, the first support ring structure 13 is able to move forwards or backwards with respect to the base structure 15. When the complementary cam member (not shown) is located at one end 18*f* of the inclined cam surface 18*e* the first support ring structure 13 is in the retracted position, or rest position (similar to that of FIGS. 6*a* and 6*b*); when instead the complementary member is at the opposite end 18*g* of the inclined cam surface 18*e*, the first support ring structure 13 is in the advanced position, or coupled position (similar to that shown in FIGS. 7*a* and 7*b*).

Obviously other forms of the cam surfaces 18*e*, for example a curvilinear form, are possible, provided that these surfaces are able to introduce an axial component of movement of the first support ring structure 13 with respect to the base structure 15 owing to a relative rotation of said structures.

Figure 13:
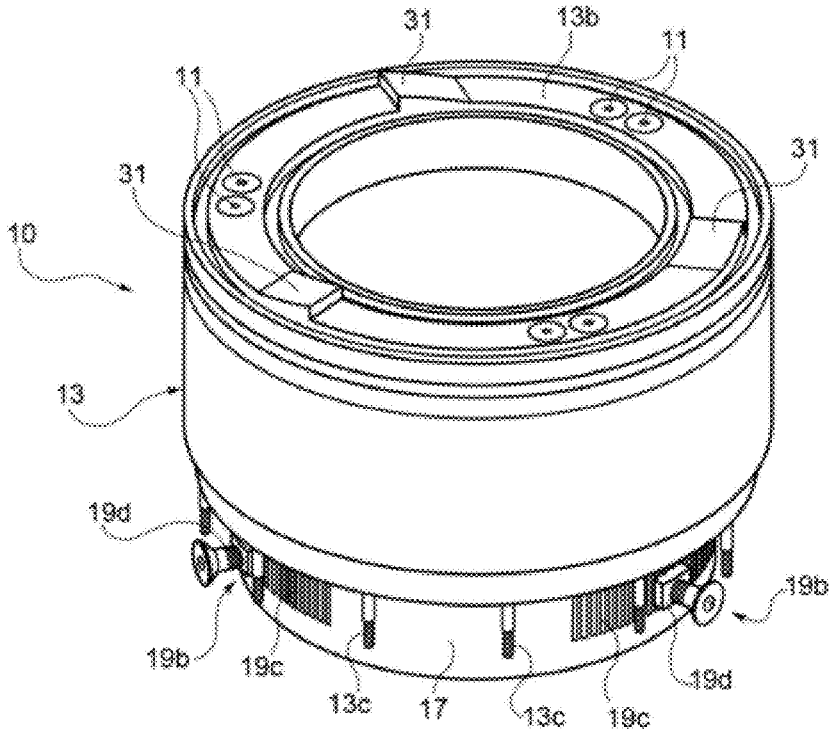
FIGS. 13 to 15 show, respectively, a partial view, an exploded view and a second partial view of a component of the end portion of FIGS. 4 and 5, according to a fourth embodiment of the invention.
Figure 14:
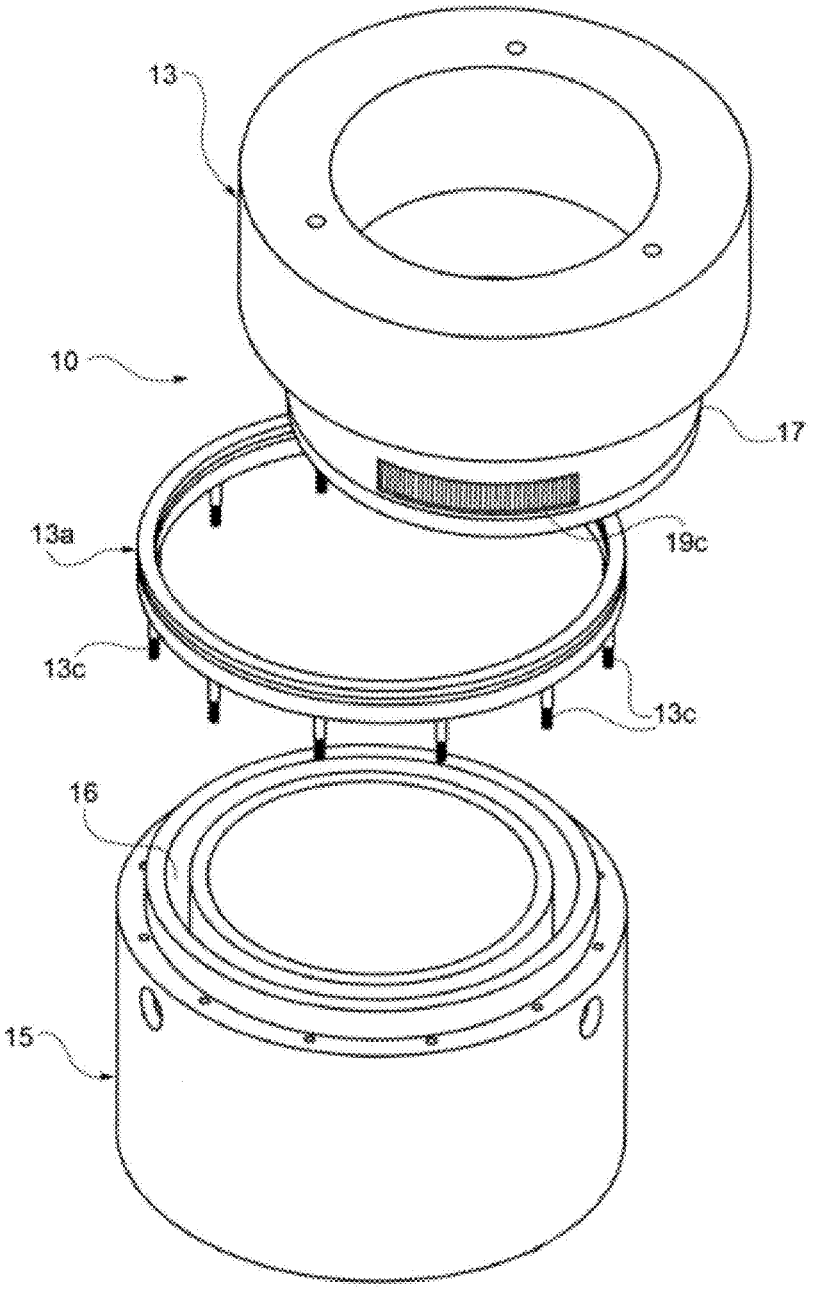
Figure 15:
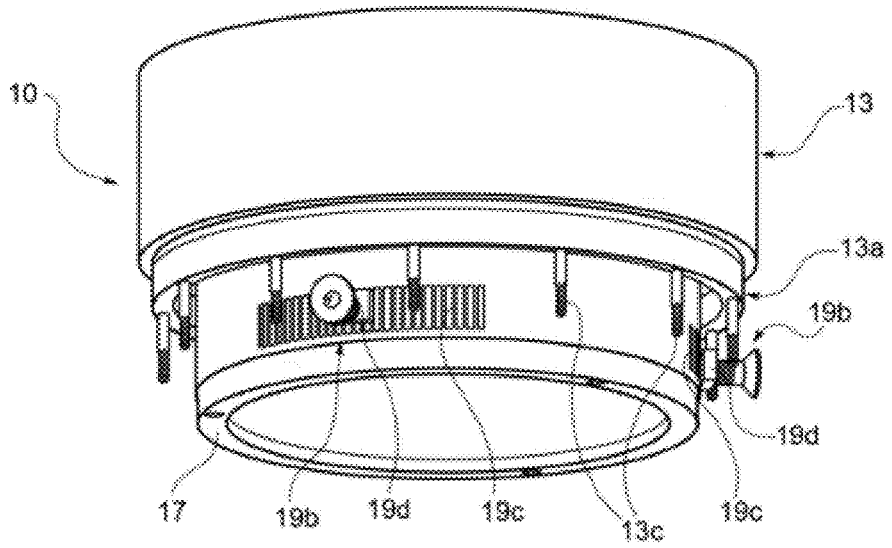

FIGS. 13 to 15 show the support ring structure of the first connector part, according to a fourth embodiment of the invention. Parts which correspond to those of the preceding embodiments have been assigned the same reference numbers and will not be further described.

The fourth embodiment shown in FIGS. 13 to 15 differs from the preceding embodiments in that the cam member is replaced by a different mechanism.

In a similar manner to the preceding embodiments, the first connector part 10 comprises a support ring structure 13 which is associated with the first tubular element and which supports in turn the first end part 11 of the conduit or transmission line (these end parts are visible in FIG. 13).

In a similar manner to the preceding embodiments, the first connector part 10 also comprises a base structure 15 which is fixed to the first tubular element 1 (visible only in FIG. 14, while for clarity of illustration it has been omitted in FIGS. 13 and 15), which also has a ring shape, and is arranged coaxially with the axis of extension of the first tubular element 1. The first support ring structure 13 is mounted on said base structure 15, being movable axially and rotatably with respect thereto, about the longitudinal axis of the tubular element 1.

For this purpose, the first support ring structure 13 rests on the base structure 15 by means of a thrust bearing 13*a*, which allows rotation thereof with respect to the base structure 15. This thrust bearing 13*a* is connected to the base structure 15 by means of elastic recall means 13*c* which allow an axial movement of the first support ring structure 13 with respect to the base structure 15, where the first support ring structure 13 is biased axially away from the base structure 15 by the elastic recall means. In the specific example, these elastic recall means 13*c* consist of a plurality of helical springs arranged along the perimeter of the thrust bearing 13*a* and acting axially by means of compression.

In a similar manner to the preceding embodiments, the base structure 15 has an annular cavity 16 which is formed along its entire perimeter and inside which a collar portion 17 of the first support ring structure 13, extending in a proximal direction from the first support ring structure 13, is slidingly inserted.

An elastic recall member (similar to that shown in FIGS. 6*a* and 7*c*) is also provided between first support ring structure 13 and base structure 15, said recall member being connected at one end to the first support ring structure 13 and at the other end being connected to the base structure 15. This elastic recall member is arranged so as to bias the support ring structure 13 in the circumferential direction towards its rest position (similar to that shown in FIGS. 6*a* and 6*b*). It therefore has the function of bringing the support ring structure 13 into its rest position when the tubular elements 1 and 3 are disassembled from each other.

Between first support ring structure 13 and base structure 15 or, more precisely, between the collar portion 17 and a wall of the base structure 15 facing the annular cavity 16 there is provided a stop member 19*b* as can be seen more clearly in FIG. 7*c*, which shows the first support ring structure 13 viewed separately. In the example shown, there are three separate stop members 19*b* which have the same form. More precisely, the stop member 19*b* comprises a saw-toothed band 19*c* formed on a radially outer surface of the collar portion 17 and extending parallel to the circumferential direction, and a pawl element 19*d* designed to engage with the toothed band 19*c* and integral with the base structure 15, not shown in FIGS. 13 and 15.

The teeth of the stop member 19*b* are arranged so as to allow a relative rotation of first ring structure 13 and base structure 15 solely in one direction, in particular the direction of rotation which brings the support ring structure 13 from the rest position into the coupled position, and therefore prevent rotation in a direction opposite to the rotation of the relative engaging movement of the tubular elements 1 and 3. The stop member 19*b* is arranged at a predetermined height of the collar portion 17 so as to operate in a predetermined axial position of the first support ring structure 13 with respect to the base structure 15.

In a similar manner to the preceding embodiments, locating and drive means are provided, these being designed to make the first and second support ring structures 13, 23 rotationally integral during engagement between first and second tubular elements 1, 3, and cause first and second contact elements 11, 21 to align with one another.

In the example shown, these locating and drive means consist of at least one saw-tooth 31 and at least one corresponding recess (not shown) respectively arranged on either one of the abutment surfaces 13*b* and 23*b* of the first and second support ring structures 13, 23. The stepped flank of the saw-tooth profile of the tooth 31 is arranged, with respect to the circumferential direction, so as to allow engagement with the corresponding flank of the complementary recess during the engaging movement of the tubular elements 1 and 3.

During the final stage of engagement (in this specific case, screwing) together of the tubular elements 1 and 3, at a certain point (determined by setting the angular position of the tooth 31 depending on the mutual positions of the two connector parts 10, 20 at the end of screwing), the tooth 31 of one connector part 10 starts to engage with the respective recess of the other connector part 20.

Once engagement has been achieved between tooth and recess the first and second support ring structures 13, 23 are fixed together and the first contact elements 11 (first end parts of the conduit or transmission line) remain aligned with the respective second contact elements 21 (second end parts of the conduit or transmission line). Continuing the screwing action, the first support ring structure 13 is therefore driven rotationally with respect to the base structure 15, against the action of the spring arranged in the circumferential direction (similar to that shown in FIG. 7*c*), while the second support ring structure 23 moves towards the first support ring structure 13 until the respective abutment surfaces 13*b*, 23*b* come into contact with each other. Once this contact has been achieved, the second support ring structure 23 pushes the first support ring structure 13 towards the base structure 15, against the action of the axial springs 13*c*. During this approach movement the toothed band 19*c* is brought axially to the same level as the pawl element 19*d* which therefore prevents the first support ring structure 13 from being inadvertently displaced from the angular position which it has reached.

With the contact between the abutment surfaces 13*b*, 23*b* of the support ring structures, the first support ring structure 13 is therefore biased axially by the axial springs 13*c* against the second support ring structure 23. The first contact elements 11 are therefore also brought into contact with the second contact elements 21, thus obtaining closing of the electrical contact, in a similar manner to that shown in FIG. 3.

Coupling between the first and second connector parts 10, 20 is therefore completed by the fact that the first support ring structure 13 is biased by the elastic recall means 13*c* against the second support ring structure 23, with the respective abutment surfaces 13*b*, 23*b* in mutual contact, thus ensuring a hydraulic seal which prevents liquids and dirt from penetrating into the seats housing the contact elements 11, 21. In order to prevent the electrical parts from coming into contact with water, sludge or other liquids during operation, seals (not shown) are provided, being arranged in an manner which may be easily determined by the person skilled in the art, for example on the abutment surfaces 13*b* and 23*b* and on the casing 17 and 27 of the first and second contact elements 11 and 21.

Any further screwing together of the tubular elements once the coupled position has been reached involves only a further relative rotation by a variable amount of the first/second support ring structure 13, 23 and base structure 15, without misalignment of the contacts.

The invention claimed is:

1. Connector comprising:

a first connector part and a second connector part which can be coupled to each other and comprise at least one first end part of a conduit or transmission line and at least one second end part of a conduit or transmission line, respectively, for contacting with one another when first and second connector parts are coupled to each other; and a first tubular element and a second tubular element which support the first and the second connector parts, respectively, and can be assembled with one another by means of an engaging movement so as to obtain coupling between the first and second connector parts, said engaging movement comprising a component of relative rotation of first and second tubular elements, about a longitudinal axis thereof;

wherein said first and second connector parts comprise a first support ring structure and a second support ring structure, respectively, which carry the first end part of a conduit or transmission line and the second end part of a conduit or transmission line, respectively, characterized in that said first and second end parts of a conduit or transmission line are positioned along a circumferential arc of the first support ring structure and second support ring structure, respectively; and said first connector part further comprises a base structure which is fixed to said first tubular element and on which said first support ring structure is mounted for axial movement and rotation about said longitudinal axis, there being provided locating and drive means which are arranged between first and second support ring structures and which are designed to make first and second support ring structures rotationally integral with one another during a final stage of the relative engaging movement of first and second tubular elements and cause first and second end parts of a conduit or transmission line to align with one another, and there being provided force-transmitting means which are arranged between base structure and first support ring structure and which are designed to axially bias the first support ring structure against the second support ring structure during a final stage of the relative engaging movement of first and second tubular elements, thereby achieving coupling between first and second connector parts.

2. Connector according to claim 1, wherein said force-transmitting means consist of cam means which are designed to operate at the end of the engagement between first and second tubular elements so as to convert a relative rotation of first support ring structure and base structure into an axial movement of the first support ring structure against the second support ring structure, thereby achieving coupling between first and second connector parts.

3. Connector according to claim 2, wherein said base structure has an annular cavity formed along its entire perimeter, within which a collar portion of the first support ring structure, which extends in a proximal direction from the first support ring structure, is slidingly inserted.

4. Connector according to claim 3, wherein said cam means comprise:

at least one cam groove formed on a radially outer surface of the collar portion of the first support ring structure and comprising a transition groove section arranged obliquely with respect to the circumferential direction; and a corresponding cam follower which guidedly engages in the cam groove and is integral with the base structure.

5. Connector according to claim 4, wherein said cam groove further comprises an initial groove section extending parallel to the circumferential direction and a final groove section also extending parallel to the circumferential direction and arranged in an axially inner position with respect to the initial groove section, said transition groove section joining the initial groove section to the final groove section.

6. Connector according to claim 3, wherein said cam means comprise at least one cam surface frontally formed on the edge of the collar portion of the first support ring structure and extending obliquely with respect to the circumferential direction.

7. Connector according to claim 1, wherein said force-transmitting means consist of elastic recall means for axially biasing the first support ring structure away from the base structure.

8. Connector according to claim 7, further comprising stop means arranged between first support ring structure and base structure and designed to prevent a relative rotation of first support ring structure and base structure in a direction opposite to said component of relative rotation of the engaging movement, said stop means being designed to operate in a predetermined axial position of the first support ring structure with respect to the base structure.

9. Connector according to claim 8, wherein said stop means comprise at least one saw-toothed band formed on a radially outer surface of the collar portion and extending parallel to the circumferential direction, and a pawl element designed to engage with the saw-toothed band and integral with the base structure.

10. Connector according to claim 1, wherein said locating and drive means are arranged on either one of opposite abutment surfaces, respectively, of the first and second support ring structures, respectively.

* * * * *